US010663875B2

(12) United States Patent
Sakimura et al.

(10) Patent No.: US 10,663,875 B2
(45) Date of Patent: May 26, 2020

(54) ELECTROPHOTOGRAPHIC PHOTORECEPTOR, AND ELECTROPHOTOGRAPHIC IMAGE FORMING METHOD AND ELECTROPHOTOGRAPHIC IMAGE FORMING APPARATUS USING THE SAME

(71) Applicant: Konica Minolta, Inc., Tokyo (JP)

(72) Inventors: Tomoko Sakimura, Hino (JP); Hiroki Takao, Hachioji (JP); Mayuko Matsusaki, Hino (JP); Kengo Ikeda, Kitamoto (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/518,251

(22) Filed: Jul. 22, 2019

(65) Prior Publication Data

US 2020/0081360 A1 Mar. 12, 2020

(30) Foreign Application Priority Data

Sep. 7, 2018 (JP) ..... 2018-167969

(51) Int. Cl.

| | |
|---|---|
| ***G03G 5/00*** | (2006.01) |
| ***G03G 5/147*** | (2006.01) |
| ***G03G 15/00*** | (2006.01) |

(52) U.S. Cl.

CPC ..... *G03G 5/14773* (2013.01); *G03G 5/14704* (2013.01); *G03G 5/14717* (2013.01); *G03G 5/14734* (2013.01); *G03G 5/14786* (2013.01); *G03G 15/75* (2013.01)

(58) Field of Classification Search

CPC ..... G03G 5/14704; G03G 5/14717; G03G 5/14734; G03G 5/14773; G03G 5/14786

USPC ..... 430/66

See application file for complete search history.

(56) References Cited

FOREIGN PATENT DOCUMENTS

| | | | |
|---|---|---|---|
| JP | H05-265244 | A | 10/1993 |
| JP | 2011154067 | A | 8/2011 |

*Primary Examiner* — Mark A Chapman

(74) *Attorney, Agent, or Firm* — Lucas & Mercanti, LLP

(57) ABSTRACT

An electrophotographic photoreceptor includes an outermost layer formed of a polymerized cured product of a composition containing a polymerizable monomer and metal oxide particles surface-treated with a surface treatment agent having a silicone chain, wherein a ratio (r/r') between a number average primary particle diameter (r) of metal oxide particles which are untreated base particles of the metal oxide particles surface-treated with the surface treatment agent having a silicone chain and a sphere equivalent particle diameter (r') of the untreated base particles calculated from a specific surface area measured by a nitrogen adsorption method is 1.5 or more and 6.0 or less, and a surface treatment amount with the surface treatment agent having a silicone chain per surface area of the untreated base particles is 0.0005 g/m$^2$ or more and 0.0015 g/m$^2$ or less.

8 Claims, 1 Drawing Sheet

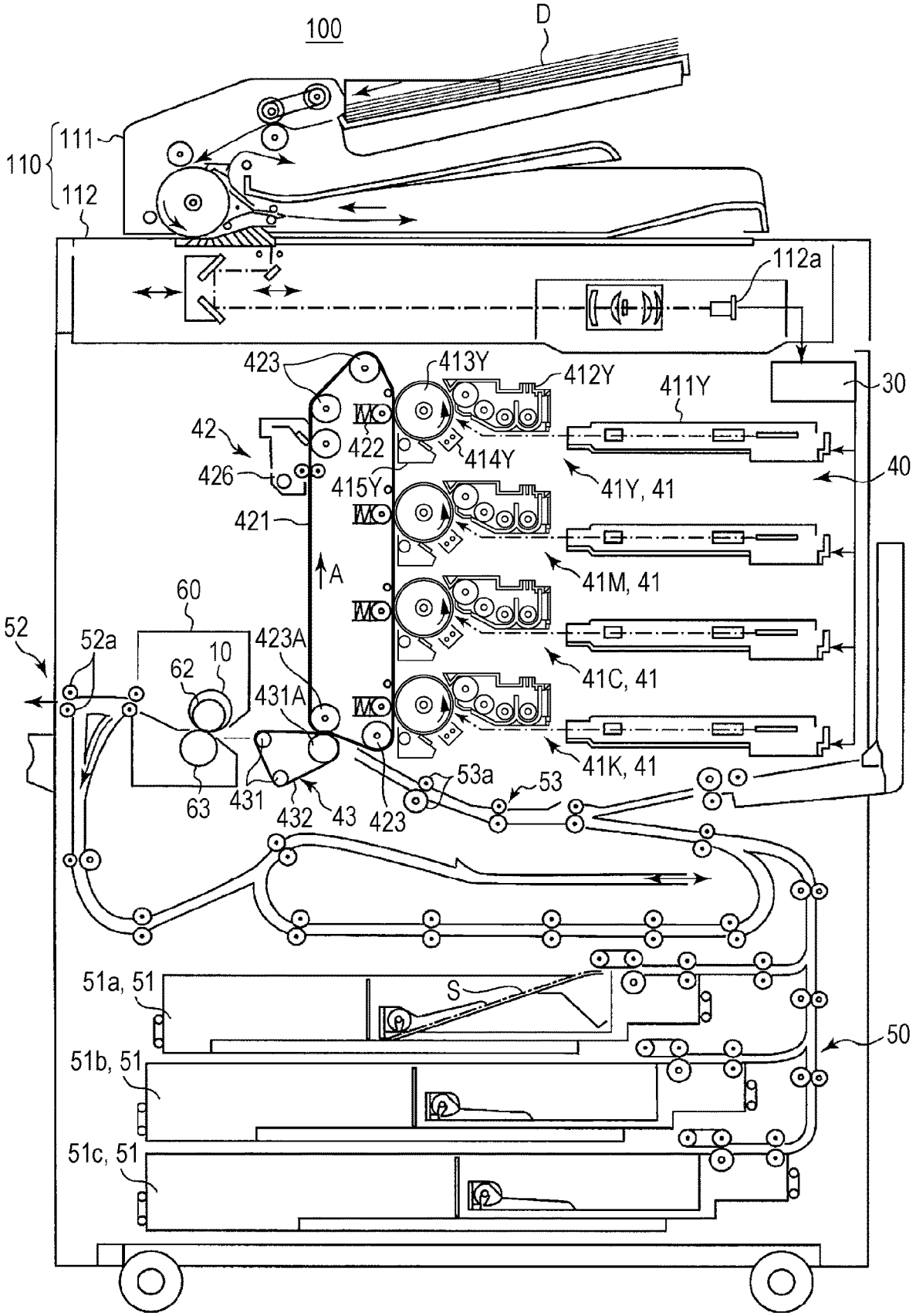
100
D
110
111
112
112a
30
423
413Y
412Y
411Y
42
422
414Y
426
415Y
41Y, 41
40
421
A
41M, 41
60
52
52a
10
62
423A
41C, 41
431A
41K, 41
53a
53
63
431
432
43
423
51a, 51
S
50
51b, 51
51c, 51

ELECTROPHOTOGRAPHIC PHOTORECEPTOR, AND ELECTROPHOTOGRAPHIC IMAGE FORMING METHOD AND ELECTROPHOTOGRAPHIC IMAGE FORMING APPARATUS USING THE SAME

The entire disclosure of Japanese patent Application No. 2018-167969, filed on Sep. 7, 2018, is incorporated herein by reference in its entirety.

BACKGROUND

Technological Field

The present invention relates to an electrophotographic photoreceptor, and an electrophotographic image forming method and an electrophotographic image forming apparatus using the same.

Description of the Related Art

Generally, an electrophotographic type image forming apparatus includes a cleaner in order to remove residual toner such as transfer residual toner attached to a surface of an electrophotographic photoreceptor (hereinafter, also simply referred to as a photoreceptor). However, in order to improve toner removing power from the surface of the photoreceptor due to a recent demand for higher definition and higher image quality, a case where cleaning is performed under conditions where a load on the photoreceptor is larger than in the past is increasing. As a result, a problem that the photoreceptor is worn out during cleaning to shorten the life of the photoreceptor has become apparent.

In the electrophotographic type image forming apparatus, it is required to cope with an increase in a printing speed (the number of printed sheets per hour). In order to increase the printing speed, it is necessary to increase a line speed of the image forming apparatus. Therefore, it is necessary to increase a rotational speed of the photoreceptor, and simultaneously to increase a rotational speed of a developing sleeve of a developing device to ensure developability. However, when the rotational speed of the photoreceptor or the rotational speed of the developing sleeve is increased, toner is easily scattered. Therefore, a part of the scattered toner is attached to a surface of the photoreceptor. As a result, fogging of an image (background fogging) occurs disadvantageously.

JP 5-265244 A and JP 2011-154067 A have proposed a method for adding metal oxide fine particles (filler) to a surface layer for the purpose of improving abrasion resistance of a photoreceptor and suppressing wear of the photoreceptor. JP 5-265244 A and JP 2011-154067 A have paid attention to improvement of dispersibility of metal oxide fine particles in order to improve abrasion resistance of the photoreceptor and simultaneously to achieve high image quality, and have studied use of metal oxide fine particles treated with silicone oil as a means therefor.

SUMMARY

However, by the methods disclosed in JP 5-265244 A and JP 2011-154067 A, it is confirmed that abrasion resistance of the photoreceptor is improved to a certain degree, but improvement with respect to reduction in image quality due to occurrence of fogging cannot be obtained disadvantageously. Therefore, an object of the present invention is to provide a means for achieving high image quality by suppressing occurrence of fogging while improving abrasion resistance in an electrophotographic photoreceptor.

To achieve the abovementioned object, according to an aspect of the present invention, an electrophotographic photoreceptor reflecting one aspect of the present invention comprises an outermost layer formed of a polymerized cured product of a composition containing a polymerizable monomer and metal oxide particles surface-treated with a surface treatment agent having a silicone chain, wherein a ratio (r/r') between a number average primary particle diameter (r) of metal oxide particles which are untreated base particles of the metal oxide particles surface-treated with the surface treatment agent having a silicone chain and a sphere equivalent particle diameter (r') of the untreated base particles calculated from a specific surface area measured by a nitrogen adsorption method is 1.5 or more and 6.0 or less, and a surface treatment amount with the surface treatment agent having a silicone chain per surface area of the untreated base particles is 0.0005 $g/m^2$ or more and 0.0015 $g/m^2$ or less.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 1 is a schematic cross-sectional view exemplifying a configuration of an image forming apparatus according to an embodiment the present invention.

DETAILED DESCRIPTION OF EMBODIMENTS

Hereinafter, a preferable embodiment of the present invention will be described with reference to the drawings. However, the scope of the invention is not limited to the disclosed embodiments. Here, "X to Y" indicating a range means "X or more and Y or less". Unless otherwise specified, operation, measurement of physical properties, and the like are performed under conditions of room temperature (20 to 25° C.)/relative humidity 40 to 50% RH.

Moreover, "(meth)acrylate" is a generic term for acrylate and methacrylate. A compound or the like including (meth), such as (meth)acrylic acid, is similarly a generic term for a compound including "meth" and a compound not including "meth" in a name.

In the description of the drawings, the same elements are denoted by the same reference numerals, and duplicate description is omitted. A dimensional ratio in the drawings is exaggerated for convenience of explanation and may differ from the actual ratio.

<Electrophotographic Photoreceptor>

An embodiment of the present invention relates to an electrophotographic photoreceptor having an outermost layer formed of a polymerized cured product of a composition containing a polymerizable monomer and metal oxide particles surface-treated with a surface treatment agent having a silicone chain, in which a ratio (r/r') between a number average primary particle diameter (r) of metal oxide particles which are untreated base particles of the metal oxide particles surface-treated with the surface treatment agent having a silicone chain and a sphere equivalent particle diameter (r') of the untreated base particles calculated from a specific surface area measured by a nitrogen adsorption method is 1.5 or more and 6.0 or less, and a surface treatment amount with the surface treatment agent having a silicone chain per surface area of the untreated base particles is 0.0005 $g/m^2$ or more and 0.0015 $g/m^2$ or less.

The present inventor estimates a mechanism by which the problem is solved with the above configuration as follows.

In an electrophotographic image forming apparatus, usually, negatively chargeable toner and a photoreceptor in which a surface charged in a charging step has negative chargeability which is the same polarity as the toner are used. Charged toner is attached to a portion where an absolute value of the potential is reduced by image exposure from a surface potential (V0) of the surface of the photoreceptor charged in the charging step, and visualization (development) is thereby performed. At the time of development, abrasion occurs between the rotating photoreceptor and the toner on a developing sleeve, and therefore frictional charging occurs. At this time, the surface of the photoreceptor is charged in a direction in which the absolute value of the surface potential (V0) of the photoreceptor is reduced. Therefore, even in a dark place (even in the absence of image exposure), the surface potential of the photoreceptor falls below the surface potential (V0) obtained when the surface of the photoreceptor is charged in the charging step. A repulsive force between the toner and the surface of the photoreceptor is reduced due to the reduction of the absolute value of the surface potential (V0) of the photoreceptor. Therefore, the toner is easily attached to the surface of the photoreceptor. Due to this, the toner attached to a portion of the surface of the photoreceptor other than an exposed portion causes fogging. In particular, in a high-speed electrophotographic image forming apparatus, the rotational speed of each of the photoreceptor and the developing sleeve is high, a frictional force between the surface of the photoreceptor and the toner is large, and a frictional charging effect by abrasion is also large. Therefore, it is considered that fogging increases.

A silicone material such as a surface treatment agent having a silicone chain used in an embodiment of the present invention has negative chargeability which is the same polarity as the toner in frictional charging order. Therefore, by adding metal oxide particles surface-treated with a surface treatment agent having a silicone chain to an outermost layer of the photoreceptor and exposing the particles to the surface of the photoreceptor, reduction of the absolute value of the surface potential (V0) of the photoreceptor charged in an electrophotographic process by abrasion of the developing sleeve is suppressed. As a result, even if the toner is scattered, the toner is hardly attached to the surface of the photoreceptor, and fogging is suppressed.

However, in order to obtain the effects as described above, it is necessary to introduce a certain amount or more of silicone chains into surfaces of the metal oxide particles, and to uniformly form the above particle exposed portion in the outermost layer of the photoreceptor. Metal oxide particles having low heteromorphism, that is, metal oxide particles having a small r/r' have a small specific surface area, require a small amount of a surface treatment agent having a silicone chain capable of reacting with hydroxy groups on surfaces of the particles, and make an effect of suppressing fogging insufficient. In addition, the amount of the surface treatment agent tends to be excessive with respect to the number of hydroxy groups on surfaces of the particles, and the amount of the unreacted surface treatment agent is increased. This reduces film strength of the outermost layer of the photoreceptor and makes the photoreceptor easily worn out. Meanwhile, even when the metal oxide particles have high heteromorphism, if the metal oxide particles have a significantly large r/r' and low symmetry, such as needle-like particles or plate-like particles, it is difficult to uniformly form an exposed portion of the particles in the outermost layer of the photoreceptor, and an effect of suppressing fogging is insufficient. From these facts, as found by the present inventors, the metal oxide particles which are untreated base particles require to have an r/r' of 1.5 or more and 6.0 or less, indicating having a certain degree of symmetry and a certain degree of heteromorphism, that is, a certain degree of specific surface area.

When a surface treatment amount with the surface treatment agent having a silicone chain per surface area of the metal oxide particles which are untreated base particles is small, it is difficult to introduce a certain amount or more of silicone chains into surfaces of the metal oxide particles, and an effect of suppressing fogging is insufficient. When the surface treatment amount is excessive, the amount of the surface treatment agent is excessive with respect to the number of hydroxy groups on surfaces of the particles, and the unreacted surface treatment agent reduces film strength of the outermost layer of the photoreceptor and makes the photoreceptor easily worn out. From these facts, as found by the present inventors, the surface treatment amount is required to be 0.0005 $g/m^2$ or more and 0.0015 $g/m^2$ or less which is a range that does not make the amount of the surface treatment agent excessive with respect to the number of hydroxy groups on surfaces of the metal oxide particles which are untreated base particles while a certain amount or more of silicone chains are introduced into the surfaces of the particles.

Note that the above mechanism is based on speculation, and correctness or fault of the mechanism does not affect the technical scope of the present invention.

The electrophotographic photoreceptor is an object that carries a latent image or a developed image on a surface thereof in an electrophotographic type image forming method. The photoreceptor has a similar configuration to a conventional photoreceptor except that the photoreceptor has an outermost layer described later, and can be prepared in a similar manner to a conventional photoreceptor. The outermost layer also has a similar configuration to a conventional outermost layer within a range including characteristics described later, and can be prepared in a similar manner to the conventional outermost layer. A portion other than the outermost layer can have the same configuration as a portion other than an outermost layer in a photoreceptor described in, for example, JP 2012-078620 A. The outermost layer can also have the same configuration as that described in JP 2012-078620 A except that there is a difference in material.

The electrophotographic photoreceptor is not particularly limited, but preferred examples thereof include an electrophotographic photoreceptor including a conductive support, a photosensitive layer disposed on the conductive support, and a protective layer disposed on the photosensitive layer as an outermost layer. Hereinafter, an electrophotographic photoreceptor having such a configuration will be described in detail.

(Conductive Support)

The conductive support is a member that supports the photosensitive layer and has conductivity. Preferred examples of the conductive support include: a plastic film having a metal drum or sheet, or a laminated metal foil; a plastic film having a film of a vapor-deposited conductive material; a metal member or a plastic film having a conductive layer formed by applying a conductive material or a coating material containing the conductive material and a binder resin, and paper. Preferred examples of the metal include aluminum, copper, chromium, nickel, zinc, and stainless steel. Preferred examples of the conductive material include the metal, indium oxide, and tin oxide.

(Photosensitive Layer)

The photosensitive layer is a layer for forming an electrostatic latent image of a desired image on a surface of the photoreceptor by exposure described later. The photosensitive layer may be a single layer or may include a plurality of laminated layers. Preferred examples of the photosensitive layer include a single layer containing a charge transporting material and a charge generating material, and a laminate of a charge transporting layer containing a charge transporting material and a charge generating layer containing a charge generating material.

(Protective Layer)

The protective layer is a layer for improving mechanical strength of a surface of the photoreceptor and improving scratch resistance and abrasion resistance. Preferred examples of the protective layer include a layer formed of a polymerized cured product of a composition containing a polymerizable monomer.

(Other Components)

The photoreceptor may further include a component other than the above conductive support, photosensitive layer, and protective layer. Preferred example of the other component include an intermediate layer. The intermediate layer is, for example, a layer disposed between the conductive support and the photosensitive layer and having a barrier function and an adhesion function.

(Outermost Layer)

Here, the outermost layer of the photoreceptor refers to a layer disposed on an outermost portion in contact with toner. The outermost layer is not particularly limited, but is preferably the above protective layer. For example, when the photoreceptor includes the conductive support, the photosensitive layer, and the protective layer, and the protective layer is the outermost layer, the photoreceptor has a laminated structure formed by laminating the conductive support, the photosensitive layer, and the protective layer in this order and disposing the protective layer on an outermost portion in contact with toner.

In an embodiment of the present invention, the outermost layer is formed of a polymerized cured product of a composition containing a polymerizable monomer and metal oxide particles surface-treated with a surface treatment agent having a silicone chain (hereinafter, also referred to as an outermost layer forming composition).

The thickness of the outermost layer can be appropriately set to a preferable value according to the type of photoreceptor, and is preferably 0.2 μm or more and 15 μm or less, and more preferably 0.5 μm or more and 10 μm or less in a general photoreceptor.

Hereinafter, the components of the outermost layer will be described in detail.

[Metal Oxide Particles Surface-Treated with Surface Treatment Agent Having Silicone Chain]

The outermost layer is formed of a cured product of a composition containing metal oxide particles that have been subjected to surface treatment with a surface treatment agent having a silicone chain (hereinafter, also simply referred to as a silicone surface treatment) (hereinafter, also simply referred to as silicone surface-treated particles). As a result of the surface treatment, the silicone surface-treated particles are considered to become coated particles containing a coating layer derived from the surface treatment agent, containing the surface treatment agent having a silicone chain, and the metal oxide particles. Note that here, the coated particle represents a particle in which a chemical species derived from the surface treatment agent is present on at least a part of a surface of the metal oxide particle.

Metal Oxide Particle (Untreated Base Particle, Untreated Metal Oxide Particle)

Here, the metal oxide particle refers to a particle in which at least a surface is formed of metal oxide.

The metal oxide constituting the metal oxide particle is not particularly limited, and examples thereof include silica (silicon oxide), magnesium oxide, zinc oxide, lead oxide, alumina (aluminum oxide), tantalum oxide, indium oxide, bismuth oxide, yttrium oxide, cobalt oxide, copper oxide, manganese oxide, selenium oxide, iron oxide, zirconium oxide, germanium oxide, tin oxide, titanium dioxide, niobium oxide, molybdenum oxide, vanadium oxide, copper aluminum oxide, and antimony-doped tin oxide. These metal oxide particles can be used singly or in combination of two or more types thereof.

Among these compounds, silica ($SiO_2$), tin oxide ($SnO_2$), titanium dioxide ($TiO_2$), and antimony-doped tin oxide ($SnO_2$—Sb) are preferable.

The metal oxide particle is preferably a composite particle having a core-shell structure including a core material (core) and an outer shell (shell) formed of metal oxide. The composite particle can increase a specific surface area thereof without excessively deforming the particle. When such a particle is used, the amount of the surface treatment agent having a silicone chain capable of reacting with a hydroxy group on a surface of the particle can be increased, and the silicone surface-treated particles can be exposed more uniformly to a surface of the photoreceptor. Therefore, an effect of suppressing fogging is further improved. A material constituting the core material (core) of the composite particle is not particularly limited, and examples thereof include barium sulfate, alumina, and silica. Among these compounds, barium sulfate ($BaSO_4$) and silica ($SiO_2$) are preferable from a viewpoint of securing transparency of the outermost layer. A material constituting the outer shell (shell) of the composite particle is similar to those exemplified as the metal oxide constituting the metal oxide particle. Preferred examples of the composite particle having a core-shell structure include a composite particle having a core-shell structure including a core material formed of barium sulfate and an outer shell formed of tin oxide, and a particle including a core material formed of silica and an outer shell formed of antimony ion-doped tin oxide. Note that a ratio between the number average particle diameter of the core material and the thickness of the outer shell only needs to be appropriately set according to the types of core material and outer shell used and a combination thereof so as to obtain desired heteromorphism.

A lower limit value of the number average primary particle diameter (r) of the metal oxide particles which are untreated base particles is not particularly limited, but is preferably 10 nm or more, more preferably 20 nm or more, still more preferably 50 nm or more, and particularly preferably 80 nm or more. Within this range, toner is preferentially brought into contact with the silicone surface-treated particles on a surface of the photoreceptor due to unevenness of particles exposed to a surface of the outermost layer of the photoreceptor. In this case, attachment of the toner to a portion of the surface of the photoreceptor other than an exposed portion is suppressed by a repulsive force between the toner and the particles. Therefore, an effect of suppressing fogging is further improved. An upper limit value of the number average primary particle diameter (r) of the metal oxide particles which are untreated base particles is not particularly limited, but is preferably 500 nm or less, more preferably 250 nm or less, and still more preferably 200 nm or less. Within this range, sedimentation of the silicone surface-treated particles in an outermost layer forming coating solution can be further suppressed during formation of the outermost layer, and the silicone surface-treated particles can be more uniformly exposed to the surface of the photoreceptor. Therefore, an effect of suppressing fogging is further improved. As a preferable example, the number average primary particle diameter (r) of the metal oxide particles is 50 nm or more and 200 nm or less.

Note that here, the number average primary particle diameter (r) of the metal oxide particles which are untreated base particle is defined as a number average primary particle diameter measured by the following method.

First, a photograph taken with a scanning electron microscope (manufactured by JEOL Ltd.) and enlarged with a magnification of 10000 is taken into a scanner. Subsequently, 300 particle images excluding aggregated particles are randomly extracted from the obtained photograph image and binarized using an automatic image processing and analysis system LUZEX (registered trademark) AP software Ver. 1.32 (manufactured by Nireco Co., Ltd.) to calculate a horizontal direction Feret diameter of each of the particle images. Then, an average value of the horizontal direction Feret diameters of the particle images is calculated to be taken as a number average primary particle diameter. Here, the horizontal direction Feret diameter refers to the length of a side of a circumscribed rectangle parallel to an x axis when the particle images are binarized.

Here, the measurement of the state of the surface-treated metal oxide particles and the number average primary particle diameter of the metal oxide particles which are untreated base particles in a state where the particles are contained in the outermost layer is performed for a metal oxide particle not having a surface treatment portion (coating layer portion) with the surface treatment agent. In addition, the number average primary particle diameter of the metal oxide particles which are untreated base particles may be measured by preparing the same particles as the metal oxide particles which are untreated base particles used for surface treatment, and evaluation be made by adopting this value.

Note that a particle size distribution of the number average primary particle diameter (r) of the metal oxide particles which are untreated base particles is not particularly limited, but a standard deviation σ thereof is preferably 10 to 30 nm.

A ratio (r/r') between the number average primary particle diameter (r) of the metal oxide particles which are untreated base particles and a sphere equivalent particle diameter (r') of the metal oxide particles which are untreated base particles calculated from a specific surface area measured by a nitrogen adsorption method is 1.5 or more. When the metal oxide particles have low heteromorphism, that is, when the particles have an r/r' of less than 1.5, an effect of suppressing fogging is insufficient, and the photoreceptor tends to be worn out. A reason for this is presumed to be that the specific surface area of the particles is small and the amount of the surface treatment agent having a silicone chain capable of reacting with hydroxy groups on surfaces of the particles is small. In addition, the reason is presumed to be that the amount of the unreacted surface treatment agent is increased by excessively using the surface treatment agent with respect to the number of hydroxy groups on the surfaces of the particles, reducing film strength of the outermost layer of the photoreceptor. From this, the r/r' is preferably 1.7 or more, more preferably 2 or more, and still more preferably 3 or more. An upper limit value of the ratio (r/r') between the number average primary particle diameter (r) of the metal oxide particles and the sphere equivalent particle diameter (f) of the metal oxide particles calculated from a specific surface area measured by a nitrogen adsorption method is 6 or less. Even when the particles have high heteromorphism, if the r/r' exceeds 6, an effect of suppressing fogging is insufficient. A reason for this is presumed to be that in particles with low symmetry, such as needle-like or plate-like particles having an r/r' of more than 6, it is difficult to uniformly form an exposed portion of the coated particles in the outermost layer of the photoreceptor. From this, the r/r' is preferably 5.6 or less, more preferably 5.4 or less, and still more preferably 5.2 or less.

The sphere equivalent particle diameter (r') of the metal oxide particles which are untreated base particles calculated from a specific surface area measured by a nitrogen adsorption method is determined as follows. First, by a nitrogen adsorption method (BET method) using a high-accuracy specific surface area and pore distribution measuring apparatus BELSORP (registered trademark)-max (manufactured by Microtrac Bell Inc.), a specific surface area (SA) is calculated from the amount of nitrogen adsorption by a BET multipoint method. Specifically, 0.5 g of a sample is put in a measurement cell, and degassing is performed at 100° C. for two hours in a mixed gas stream containing 30% by volume of nitrogen and 70% by volume of helium. Thereafter, the temperature of the sample is maintained at a liquid nitrogen temperature in the mixed gas stream, and nitrogen is adsorbed on the sample in a manner of equilibrium adsorption. Next, the sample temperature is gradually raised to room temperature while the mixed gas flows, the amount of nitrogen desorbed during that time is detected, and the specific surface area (SA) of the metal oxide particles is calculated. Subsequently, the sphere equivalent particle diameter (r') is calculated by putting the specific surface area (SA) calculated by the above method and the density (true specific gravity) (ρ) of the metal oxide particles which are untreated base particles into the following formula.

$$\text{Sphere equivalent particle diameter } (r') \text{ [nm]} = 6000 / \{\text{specific surface area (SA) [m}^2\text{/g]} \times \text{density } (\rho) \text{ [g/cm}^3\text{]}\} \quad \text{[Numerical formula 1]}$$

Here, the measurement of the state of the surface-treated metal oxide particles and the sphere equivalent particle diameter of the metal oxide particles which are untreated base particles in a state where the particles are contained in the outermost layer is performed for a metal oxide particle not having a surface treatment portion (coating layer portion) with the surface treatment agent. In addition, the sphere equivalent particle diameter of the metal oxide particles which are untreated base particles may be measured by preparing the same particles as the metal oxide particles which are untreated base particles used for surface treatment, and evaluation be made by adopting this value.

The metal oxide particles may be a synthetic product or a commercially available product.

The metal oxide particles may be used singly or in combination of two or more types thereof.

Surface Treatment Agent Having Silicone Chain

The surface treatment agent having a silicone chain preferably has a structural unit represented by the following formula (1).

[Chemical formula 1]

Formula (1)

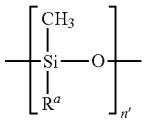

In formula (1), $R^a$ represents a hydrogen atom or a methyl group, and n' represents an integer of 3 or more.

Examples of the surface treatment agent having a silicone chain include a linear silicone surface treatment agent having a silicone chain as a main chain of a polymer chain, and a branched silicone surface treatment agent having a silicone chain as a side chain (branched silicone surface treatment agent having a silicone chain as a side chain of a polymer chain). Among these surface treatment agents, a branched silicone surface treatment agent having a silicone chain as a side chain is preferable. The branched silicone surface treatment agent having a silicone chain as a side chain has a bulky structure, can further increase the concentration of a silicone chain on the silicone surface-treated particles, and can make surfaces of the metal oxide particles hydrophobic efficiently. As a result, aggregation of the silicone surface-treated particles is further reduced, the particles are efficiently dispersed in the outermost layer, and the silicone surface-treated particles can be more uniformly exposed to the surface of the photoreceptor. Therefore, an effect of suppressing fogging is further improved.

The linear silicone surface treatment agent is preferably represented by the following formula (2).

[Chemical formula 2]

Formula (2)

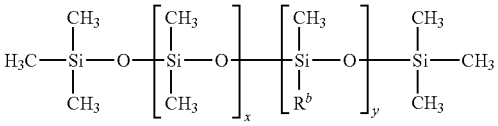

In formula (2), $R^b$ represents a hydrogen atom or a surface treatment functional group. Here, the surface treatment functional group represents a group having reactivity to a polar group such as a hydroxy group present on a surface of the metal oxide particle. Examples of $R^b$ include a hydrogen atom, a carboxylic acid group, a hydroxy group, and —$R^c$—COOH ($R^c$ represents a divalent hydrocarbon group). Among these groups, a hydrogen atom or —$R^c$—COOH is preferable. x represents an integer of 0 or more, and y represents an integer of 1 or more. At least one of x and y preferably represents 10 to 100.

The molecular weight of the linear silicone surface treatment agent is not particularly limited, but is preferably 300 or more and 10,000 or less, and more preferably 1,000 or more and 4,000 or less in terms of weight average molecular weight. Note that the weight average molecular weight of the silicone surface treatment agent can be measured using gel permeation chromatography (GPC).

The linear silicone surface treatment agent may be a synthetic product or a commercially available product. Specific examples of the commercially available product include KF-99, KF-9901, and X-22-3701E (manufactured by Shin-Etsu Chemical Co., Ltd.)

Preferably, the branched silicone surface treatment agent having a silicone chain as a side chain has a silicone chain as a side chain of a polymer chain, and further has a surface treatment functional group. Examples of the surface treatment functional group include a carboxylic acid group, a hydroxy group, —$R^d$—COOH ($R^d$ represents a divalent hydrocarbon group), a halogenated silyl group, and an alkoxysilyl group. Among these groups, a carboxylic acid group, a hydroxy group, or an alkoxysilyl group is preferable.

The branched silicone surface treatment agent having a silicone chain as a side chain preferably has a poly (meth) acrylate main chain (main chain formed of a (meth)acrylate homopolymer or a copolymer of (meth)acrylate and another monomer) or a silicone main chain as a main chain. The silicone chain as a side chain or a main chain preferably has a dimethylsiloxane structure as a repeating unit. The number of the repeating units is preferably 3 to 100, more preferably 3 to 50, and still more preferably 3 to 30.

The molecular weight of the branched silicone surface treatment agent having a silicone chain as a side chain is not particularly limited, but is preferably 1,000 or more and 50,000 or less in terms of weight average molecular weight.

The branched silicone surface treatment agent having a silicone chain as a side chain may be a synthetic product or a commercially available product. Specific examples of the commercially available branched silicone surface treatment agent having a silicone chain as a side chain branched from a poly (meth)acrylate main chain include SYMAC (registered trademark) US-350 (manufactured by Toagosei Co., Ltd.), and KP-541, KP-574, and KP-578 (manufactured by Shin-Etsu Chemical Co., Ltd.). Specific examples of the commercially available branched silicone surface treatment agent having a silicone chain as a side chain branched from a silicone main chain include KF-9908 and KF-9909 (manufactured by Shin-Etsu Chemical Co., Ltd.).

The surface treatment agent having a silicone chain may be used singly or in combination of two or more types thereof.

Surface Treatment Method with Surface Treatment Agent Having Silicone Chain

A surface treatment method with the surface treatment agent having a silicone chain is not particularly limited as long as being able to attach (or bond) the silicone surface treatment agent to surfaces of the metal oxide particles. Such methods are generally classified into two types, that is, a wet treatment method and a thy treatment method, and either of these may be used.

Note that when the metal oxide particles after a reactive surface treatment described later are subjected to silicone surface treatment, a surface treatment agent having a silicone chain is attached (or bonded) onto surfaces of the metal oxide particles or a reactive surface treatment agent attached (or bonded) thereto.

The wet treatment method is a method for attaching (or bonding) a surface treatment agent onto surfaces of metal oxide particles by dispersing the metal oxide particles and the surface treatment agent in a solvent. The method is preferably a method for dispersing metal oxide particles and a surface treatment agent in a solvent and drying the obtained dispersion to remove the solvent, and more preferably a method for further performing heat treatment thereafter and causing a reaction between the surface treatment agent and surfaces of the metal oxide particles in the particles obtained to fix the surface treatment agent onto the surfaces of the metal oxide particles. In addition, after the metal oxide particles and the surface treatment agent are dispersed in the solvent, the obtained dispersion is wet-ground to make the metal oxide particles finer and simultaneously to promote surface treatment of the particles.

A disperser for the metal oxide particles and the surface treatment agent in the solvent is not particularly limited, and a known means can be used. Examples thereof include a general disperser such as a homogenizer, a ball mill, or a sand mill.

The solvent is not particularly limited, and a known solvent can be used. The solvent may be used singly or in combination of two or more types thereof. Preferred examples thereof include an alcohol-based solvent such as methanol, ethanol, n-propyl alcohol, isopropyl alcohol, n-butanol, tert-butanol, or 2-butanol (sec-butanol), and a mixed solvent of an alcohol-based solvent and an aromatic hydrocarbon-based solvent such as toluene or xylene. Among these solvents, 2-butanol or a mixed solvent of 2-butanol and toluene is more preferable.

Dispersion time is not particularly limited, and only needs to be appropriately set according to the types and amounts of the metal oxide particles and the surface treatment agent having a silicone chain, an output of a dispersing machine, and a dispersion scale.

A method for removing a solvent is not particularly limited, and a known method can be used. Examples thereof include a method using an evaporator.

A heating temperature is not particularly limited, but is preferably 50° C. or higher and 250° C. or lower, more preferably 70° C. or higher and 200° C. or lower, and still more preferably 90° C. or higher and 150° C. or lower. Heating time is not particularly limited, but is preferably one minute or more and 600 minutes or less, more preferably 10 minutes or more and 300 minutes or less, and still more preferably 30 minute or more and 200 minutes or less. Note that a heating method is not particularly limited, and a known method can be used.

The amount of solvent used in the surface treatment is not particularly limited, but is preferably 10 parts by mass or more and 10000 parts by mass or less, more preferably 500 parts by mass or more and 2000 parts by mass or less, and still more preferably 750 parts by mass or more and 1500 parts by mass or less with respect to 100 parts by mass of metal oxide particles which are untreated base particles (metal oxide particles after reactive surface treatment when metal oxide particles after reactive surface treatment described later are subjected to silicone surface treatment).

The dry treatment method is a method for attaching a surface treatment agent onto surfaces of metal oxide particles by mixing and kneading the surface treatment agent and the metal oxide particles without using a solvent. The method is not particularly limited, but may be a method for kneading a surface treatment agent and metal oxide particles, and then further performing a heat treatment and causing a reaction between the surface treatment agent and surfaces of the metal oxide particles in the particles obtained to attach (or bond) the surface treatment agent onto the surfaces of the metal oxide particles. In addition, the method may be a method for dry-grinding metal oxide particles and a surface treatment agent when the metal oxide particles and the surface treatment agent are kneaded to make the metal oxide particles finer and simultaneously to promote the surface treatment of the particles.

A lower limit value of the surface treatment amount with the surface treatment agent having a silicone chain per surface area of the metal oxide particles which are untreated base particles is 0.0005 g/m$^2$ or more. When the surface treatment amount is less than 0.0005 g/m$^2$, an effect of suppressing fogging is insufficient. A reason for this is presumed to be that it is difficult to introduce a certain amount or more of silicone chains into surfaces of the metal oxide particles. The surface treatment amount is preferably 0.0006 g/m$^2$ or more from a viewpoint of improving an effect of suppressing fogging. An upper limit value of the surface treatment amount with the surface treatment agent having a silicone chain per surface area of the metal oxide particles which are untreated base particles is 0.0015 g/m$^2$ or less. When the surface treatment amount exceeds 0.0015 g/m$^2$, the photoreceptor tends to be worn out. A reason for this is presumed to be that the amount of surface treatment agent is excessive with respect to the number of hydroxy groups on the surfaces of the particles, and the unreacted surface treatment agent reduces film strength of the outermost layer of the photoreceptor. The surface treatment amount is preferably 0.00010 g/m$^2$ or less from a viewpoint of reducing the wear of the photoreceptor.

Note that the surface treatment amount with the surface treatment agent having a silicone chain per surface area of the metal oxide particles which are untreated base particles (untreated metal oxide particles) can be calculated by the following formula;

Surface treatment amount by surface treatment agent having silicone chain per surface area of metal oxide particles [g/m$^2$]=addition amount of surface treatment agent [g]/{addition amount of metal oxide particles [g]×specific surface area (SA) of metal oxide particles [m$^2$/g]} [Numerical formula 2]

A lower limit value of the surface treatment amount with the surface treatment agent having a silicone chain is not particularly limited, but is preferably 0.1% by mass or more, more preferably 1% by mass or more, and still more preferably 3% by mass or more. An upper limit of the surface treatment amount with the surface treatment agent having a silicone chain is not particularly limited, but is preferably 100% by mass or less, more preferably 10% by mass or less, and still more preferably 5% by mass or less.

Note that the surface treatment amount with the surface treatment agent having a silicone chain represents a ratio (%) of the mass of the surface treatment agent with respect to the mass of the metal oxide particles which are untreated base particles (untreated metal oxide particles), and can be calculated by the following formula;

Surface treatment amount by surface treatment agent having silicone chain [% by mass]={addition amount of surface treatment agent [g]/{addition amount of metal oxide particles [g]}×100 [Numerical formula 3]

It can be confirmed by thermogravimetry/differential thermal analysis (TG/DTA) that the metal oxide particles which are untreated base particles and the metal oxide particles after reactive surface treatment have been subjected to surface treatment with the surface treatment agent having a silicone chain.

In addition, it can be confirmed by observation with a scanning electron microscope (SEM), observation with a transmission electron microscope (TEM), and analysis by energy dispersive X-ray spectroscopy (EDX) that the silicone surface-treated particles are coated particles containing a surface treatment agent-derived coating layer containing the surface treatment agent having a silicone chain and the metal oxide particles.

The silicone surface-treated particles preferably have a group derived from a polymerizable group. Inclusion of a group derived from a polymerizable group in the silicone surface-treated particles improves abrasion resistance of the outermost layer. A reason for this is presumed to be that the silicone surface-treated particles and the polymerizable monomer are chemically bonded to each other in a cured product constituting the outermost layer, and the film strength of the outermost layer is improved. The type of the polymerizable group is not particularly limited, but a radically polymerizable group is preferable. A method for introducing a polymerizable group is not particularly limited, but is preferably a method for further subjecting the metal oxide particles which are untreated base particles or the silicone surface-treated particles to a surface treatment with a surface treatment agent having a polymerizable group.

It can be confirmed by thermogravimetry/differential thermal analysis (TG/DTA), mass spectrometry, or the like that the silicone surface-treated particles have a polymerizable group and that the silicone surface-treated particles in the outermost layer have a group derived from a polymerizable group.

Surface Treatment Agent Having Polymerizable Group

The metal oxide particles which are untreated base particles and silicone surface-treated particles are preferably further subjected to surface treatment with a surface treatment agent having a polymerizable group (hereinafter, also referred to as a reactive surface treatment agent) (hereinafter, also referred to as reactive surface treatment). By the reactive surface treatment, the polymerizable group is carried on surfaces of the metal oxide particles which are untreated base particles and the silicone surface-treated particles, and the silicone surface-treated particles further obtain a polymerizable group. Then, the particles are polymerized with a polymerizable monomer via a polymerizable group in the outermost layer, and the outermost layer with higher mechanical strength is formed to improve abrasion resistance of the outermost layer. At this time, the silicone surface-treated particles are present as a structure having a group derived from a polymerizable group in the outermost layer.

The surface treatment agent having a polymerizable group has a polymerizable group and a surface treatment functional group. The type of the polymerizable group is not particularly limited, but a radically polymerizable group is preferable. Here, the radically polymerizable group represents a radically polymerizable group having an unsaturated bond, and is preferably a radically polymerizable group having a carbon-carbon double bond. Examples of the radically polymerizable group include a vinyl group and a (meth)acryloyl group. Among these groups, a methacryloyl group is preferable. The surface treatment functional group represents a group having reactivity to a polar group such as a hydroxy group present on surfaces of the metal oxide particles. Examples of the surface treatment functional group include a carboxylic acid group, a hydroxy group, —R'—COOH (R' represents a divalent hydrocarbon group), a halogenated silyl group, and an alkoxysilyl group. Among these groups, a halogenated silyl group and an alkoxysilyl group are preferable.

The surface treatment agent having a polymerizable group is preferably a silane coupling agent having a radically polymerizable group, and examples thereof include compounds represented by the following formulas S-1 to S-21.

[Chemical formula 3]

S-1 : $CH_2{=}CHSi(CH_3)(OCH_3)_2$

S-2 : $CH_2{=}CHSi(OCH_3)_3$

S-3 : $CH_2{=}CHSi(OC_2H_5)_3$

S-4 : $CH_2{=}CHCH_2Si(OCH_3)_3$

S-5 : $CH_2{=}CHCH_2Si(OC_2H_5)_3$

S-6 : $CH_2{=}CHCOO(CH_2)_2Si(CH_3)(OCH_3)_2$

S-7 : $CH_2{=}CHCOO(CH_2)_2Si(OCH_3)_3$

S-8 : $CH_2{=}CHCOO(CH_2)_3Si(OCH_3)_3$

S-9 : $CH_2{=}CHCOO(CH_2)_3Si(OC_2H_5)_3$

S-10 : $CH_2{=}CHCOO(CH_2)_3Si(CH_3)(OCH_3)_2$

S-11 : $CH_2{=}CHCOO(CH_2)_3SiCl_3$

S-12 : $CH_2{=}CHCOO(CH_2)_3Si(CH_3)Cl_2$

S-13 : $CH_2{=}C(CH_3)COO(CH_2)_2Si(CH_3)(OCH_3)_2$

S-14 : $CH_2{=}C(CH_3)COO(CH_2)_2Si(OCH_3)_3$

S-15 : $CH_2{=}C(CH_3)COO(CH_2)_3Si(CH_3)(OCH_3)_2$

S-16 : $CH_2{=}C(CH_3)COO(CH_2)_3Si(OCH_3)_3$

S-17 : $CH_2{=}C(CH_3)COO(CH_2)_3Si(OC_2H_5)_3$

S-18 : $CH_2{=}C(CH_3)COO(CH_2)_3Si(CH_3)Cl_2$

S-19 : $CH_2{=}C(CH_3)COO(CH_2)_3SiCl_3$

S-20 : $CH_2{=}C(CH_3)COO(CH_2)_8Si(OCH_3)_3$

S-21 :

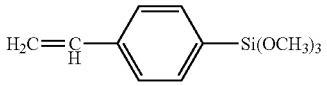

The surface treatment agent having a polymerizable group may be a synthetic product or a commercially available product. Specific examples of the commercially available product include KBM-503 and KBM-5803 (manufactured by Shin-Etsu Chemical Co., Ltd.).

The surface treatment agent having a polymerizable group may be used singly or in combination of two or more types thereof.

As a procedure of preparing the silicone surface-treated particles having a polymerizable group, preferably, metal oxide particles which are untreated base particles are subjected to reactive surface treatment and then subjected to silicone surface treatment. By performing the surface treatment in this order, abrasion resistance of the outermost layer is improved. A reason for this is presumed to be that the silicone chain having an oil repellent effect does not prevent contact of the reactive surface treatment agent with surfaces of the metal oxide particles, and introduction of a polymerizable group into the silicone surface-treated particles is easier.

A reactive surface treatment method is not particularly limited, but is preferably a method similar to the method described as the silicone surface treatment method. In addition, a known surface treatment technique for metal oxide particles may be used.

When a wet treatment method is used, a solvent is not particularly limited, and a known solvent can be used. The solvent may be used singly or in combination of two or more types thereof. Preferred examples thereof include an alcohol-based solvent such as ethanol, n-propyl alcohol, isopropyl alcohol, n-butanol, tert-butanol, or 2-butanol (sec-butanol), and a mixed solvent of an alcohol-based solvent and an aromatic hydrocarbon-based solvent such as toluene or xylene. Among these solvents, ethanol or a mixed solvent of ethanol and toluene is more preferable.

The surface treatment amount with the surface treatment agent having a polymerizable group is preferably 0.1% by mass or more, more preferably 1% by mass or more, and still more preferably 1.5% by mass or more. Within this range, abrasion resistance of the outermost layer is further improved. The surface treatment amount with the surface treatment agent having a polymerizable group is preferably 10% by mass or less, more preferably 5% by mass or less, and still more preferably 2.5% by mass or less. Within this range, abrasion resistance of the outermost layer is further improved. A reason for this is presumed to be that the amount of the surface treatment agent is not excessive with respect to the number of hydroxy groups on surfaces of the particles and is in a more appropriate range, and a decrease in the film strength of the outermost layer by the unreacted surface treatment agent is suppressed.

Note that the surface treatment amount with the surface treatment agent having a polymerizable group represents a ratio (%) of the mass of the surface treatment agent with respect to the mass of the metal oxide particles which are untreated base particles (untreated metal oxide particles), and can be calculated by the following formula;

Surface treatment amount by surface treatment agent having polymerizable group [% by mass]={addition amount of surface treatment agent [g]/{addition amount of metal oxide particles [g]}×100 [Numerical formula 4]

It can be confirmed by thermogravimetry/differential thermal analysis (TG/DTA) that the metal oxide particles which are untreated base particles and the silicone surface-treated particles have been subjected to surface treatment with the reactive surface treatment agent.

In addition, a preferable method, an apparatus, a procedure, and conditions other than the addition amounts of the metal oxide particles and the surface treatment agent are similar to those described as the silicone surface treatment method.

It can be confirmed by thermogravimetry/differential thermal analysis (TG/DTA), mass spectrometry, or the like that the metal oxide particles and silicone surface-treated particles have been subjected to surface treatment with a surface treatment agent having a polymerizable group, that the metal oxide particles and the silicone surface-treated particles after the reactive surface treatment have a polymerizable group, and that the silicone surface-treated particles in the outermost layer have a group derived from a polymerizable group.

[Polymerizable Monomer]

The outermost layer is formed of a cured product of a composition containing a polymerizable monomer. Here, the polymerizable monomer represents a compound that has a polymerizable group and is polymerized (cured) by irradiation with an actinic ray such as an ultraviolet ray, a visible ray, or an electron beam, or by addition of energy such as heating to become a resin used as a binder resin of the outermost layer. Note that the polymerizable monomer in the present application does not include the above surface treatment agent having a polymerizable group. When a polymerizable silicone compound or a polymerizable perfluoropolyether compound is used as a lubricant described later, the polymerizable monomer in the present application does not include the polymerizable silicone compound or the polymerizable perfluoropolyether compound, either.

The type of the polymerizable group included in the polymerizable monomer is not particularly limited, but a radically polymerizable group is preferable. Here, the radically polymerizable group represents a radically polymerizable group having an unsaturated bond, and is preferably a radically polymerizable group having a carbon-carbon double bond. Examples of the radically polymerizable group include a vinyl group and a (meth)acryloyl group, and a methacryloyl group is preferable. When the polymerizable group is a (meth)acryloyl group, abrasion resistance of the outermost layer and an effect of suppressing fogging are improved. A reason for the improvement of the abrasion resistance of the outermost layer is presumed to be that efficient curing with a small amount of light or in a short time is possible.

The number of polymerizable groups in one molecule of the polymerizable monomer is not particularly limited, but is preferably 2 or more, and more preferably 3 or more. Within this range, abrasion resistance of the outermost layer is improved. A reason for this is presumed to be that the crosslink density of the outermost layer is increased and the mechanical strength is further improved.

The polymerizable monomer is not particularly limited, and a known polymerizable monomer can be appropriately used. Examples thereof include crosslinkable polymerizable compounds described in paragraphs "0057" to "0062" of JP 2014-219460 A.

The polymerizable monomer may be a synthetic product or a commercially available product.

The polymerizable monomer may be used singly or in combination of two or more types thereof.

[Polymerization Initiator]

The outermost layer forming composition preferably further contains a polymerization initiator. The polymerization initiator may be a thermal polymerization initiator or a photopolymerization initiator, but is preferably a photopolymerization initiator. When the polymerizable monomer is a radically polymerizable monomer, the polymerization initiator is preferably a radical polymerization initiator. The radical polymerization initiator is not particularly limited, and a known radical polymerization initiator can be used. Examples thereof include an alkylphenone-based compound and a phosphine oxide-based compound. Among these compounds, a compound having an α-aminoalkylphenone structure or an acylphosphine oxide structure is preferable, and the compound having an acylphosphine oxide structure is more preferable. Examples of the compound having an acylphosphine oxide structure include IRGACURE (registered trademark) 819 (bis(2,4,6-trimethylbenzoyl) phenylphosphine oxide) (manufactured by BASF Japan Ltd.).

[Charge Transporting Material]

The outermost layer forming composition preferably further contains a charge transporting material. The charge transporting material is not particularly limited, and a known charge transporting material can be used. Examples thereof include a carbazole derivative, an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a styryl compound, a hydrazone compound, a pyrazoline compound, an oxazolone derivative, a benzimidazole derivative, a quinazoline derivative, a benzofuran derivative, an acridine derivative, a phenazine derivative, an aminostilbene derivative, a triarylamine derivative, a phenylenediamine derivative, a stilbene derivative, and a benzidine derivative. Among these compounds, a triarylamine derivative is preferable. The triarylamine derivative is preferably represented by following formula (3).

[Chemical formula 4]

Formula (3)

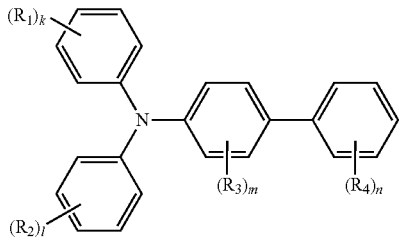

In formula (3), $R_1$, $R_2$, $R_3$, and $R_4$ each independently represent an alkyl group having 1 to 7 carbon atoms or an alkoxy group having 1 to 7 carbon atoms. k, l, and n each independently represent an integer of 0 to 5, and m represents an integer of 0 to 4. However, in a case where k, l, n, or m is 2 or more, a plurality of $R_1$s may be the same as or different from one another, a plurality of $R_2$s may be the same as or different from one another, a plurality of $R_3$s may be the same as or different from one another, and a plurality of $R_4$s may be the same as or different from one another. Among these compounds, $R_1$, $R_2$, $R_3$, and $R_4$ preferably each independently represent an alkyl group having 1 to 3 carbon atoms. k, l, n, and m preferably each independently represent an integer of 0 or 1.

As the compound represented by formula (3), for example, those described in JP 2015-114454 A can be used. In addition, the compound represented by formula (3) can be synthesized by a known synthesis method, for example, a method disclosed in JP 2006-143720 A. Examples of the compound represented by formula (3) include a compound represented by formula (5) as described in Examples.

[Other Component]

The outermost layer forming composition may further contain a component other than the above components. The other component is not particularly limited, but examples thereof include a lubricant when the outermost layer is a protective layer. The lubricant is not particularly limited, and a known lubricant can be used. Examples thereof include fluorine-based fine particles, a polymerizable silicone compound, and a polymerizable perfluoropolyether compound.

(Method for Manufacturing Electrophotographic Photoreceptor)

The electrophotographic photoreceptor according to an embodiment of the present invention can be manufactured by a known method for manufacturing an electrophotographic photoreceptor without particular limitation except that an outermost layer forming coating solution described later is used. Among these methods, the electrophotographic photoreceptor is preferably manufactured by a method including a step of applying an outermost layer forming coating solution to a surface of a photosensitive layer formed on a conductive support, and a step of irradiating the applied outermost layer forming coating solution with an active energy ray or heating the applied outermost layer forming coating solution to polymerize a polymerizable monomer in the outermost layer forming coating solution.

The outermost layer forming coating solution contains an outermost layer forming composition containing a polymerizable monomer and silicone surface-treated particles. The outermost layer forming composition preferably further contains a charge transport agent and a polymerization initiator, and may further contain a component other than these components. The outermost layer forming coating solution preferably further contains an outermost layer forming composition and a dispersion medium. Note that here, the outermost layer forming composition does not include a compound used only as a dispersion medium.

The dispersion medium is not particularly limited, and a known dispersion medium can be used. Examples thereof include methanol, ethanol, n-propyl alcohol, isopropyl alcohol, n-butanol, tert-butanol, 2-butanol (sec-butanol), benzyl alcohol, toluene, xylene, methyl ethyl ketone, cyclohexane, ethyl acetate, butyl acetate, methyl cellosolve, ethyl cellosolve, tetrahydrofuran, 1,3-dioxane, 1,3-dioxolane, pyridine, and diethylamine. The dispersion medium may be used singly or in combination of two or more types thereof.

The content of the dispersion medium with respect to the total mass of the outermost layer forming coating solution is not particularly limited, but is preferably 1% by mass or more and 99% by mass or less, more preferably 40% by mass or more and 90% by mass or less, and still more preferably 50% by mass or more and 80% by mass or less.

The content of the silicone surface-treated particles in the outermost layer forming composition is not particularly limited, but is preferably 30% by mass or more, more preferably 40% by mass or more, and still more preferably 50% by mass or more with respect to the total mass of the outermost layer forming composition. Within this range, abrasion resistance of the outermost layer and an effect of suppressing fogging are improved. A reason for this is presumed to be that as the content of the silicone surface-treated particles is increased, an effect brought by the particles is improved. The content of the silicone surface-treated particles in the outermost layer forming composition is not particularly limited, but is preferably 90% by mass or less, more preferably 80% by mass or less, and still more preferably 70% by mass or less with respect to the total mass of the outermost layer forming composition. Within this range, the content of the polymerizable monomer in the outermost layer forming composition relatively increases. Therefore, the crosslinking density of the outermost layer is increased, and the abrasion resistance can be improved.

A content ratio by mass of the polymerizable monomer with respect to the silicone surface-treated particles (the mass of the polymerizable monomer/the mass of the silicone surface-treated particles in the outermost layer forming composition) in the outermost layer forming composition is not particularly limited, but is preferably 0.1 or more, more preferably 0.2 or more, and still more preferably 0.4 or more. Within this range, abrasion resistance of the outermost layer is improved. A reason for this is presumed to be that the crosslink density of the outermost layer is increased and the mechanical strength is further improved. A content ratio by mass of the polymerizable monomer with respect to the silicone surface-treated particles in the outermost layer forming composition is not particularly limited, but is preferably 2 or less, more preferably 1 or less, and still more preferably 0.7 or less. Within this range, abrasion resistance of the outermost layer and an effect of suppressing fogging are improved. A reason for this is presumed to be that as the content of the silicone surface-treated particles in the outermost layer forming composition is relatively increased, an effect brought by the particles is improved.

When the outermost layer forming composition contains a polymerization initiator, the content thereof is not particularly limited, but is preferably 0.1 parts by mass or more, more preferably 1 part by mass or more, and still more preferably 5 parts by mass or more with respect to 100 parts by mass of the polymerizable monomer. The content of the polymerization initiator in the outermost layer forming composition is not particularly limited, but is preferably 30 parts by mass or less, and more preferably 20 parts by mass or less with respect to 100 parts by mass of the polymerizable monomer. Within this range, abrasion resistance of the outermost layer is improved. A reason for this is presumed to be that the crosslink density of the outermost layer is increased and the mechanical strength is further improved.

When the outermost layer forming composition contains a charge transport agent, the content thereof is not particularly limited, but is preferably 1 part by mass or more, more preferably 5 parts by mass or more, and still more preferably 10 parts by mass or more with respect to 100 parts by mass of the total content of the polymerizable monomer and the silicone surface-treated particles. Within this range, occurrence of a phenomena causing deterioration of image quality such as fogging is suppressed, and image quality is improved. A reason for this is presumed to be that charge transportability of the outermost layer is improved to improve a function as a photoreceptor. The content of the charge transport agent is not particularly limited, but is preferably 40 parts by mass or less, more preferably 30 parts by mass or less, and still more preferably 20 parts by mass or less with respect to the total content of the polymerizable monomer and the silicone surface-treated particles. Within this range, abrasion resistance of the outermost layer and an effect of suppressing fogging are improved. A reason for this is presumed to be that the content ratio of the silicone surface-treated particles and the polymerizable monomer in the outermost layer is sufficient.

Note that the content (% by mass) of the silicone surface-treated particles, the cured product of the polymerizable monomer, and optionally used polymerization initiator, charge transport agent, and other components (including cured products thereof if being polymerizable) with respect to the total mass of the outermost layer is almost the same as the content (% by mass) of the silicone surface-treated particles, the polymerizable monomer, and optionally used polymerization initiator, charge transport agent, and other components with respect to the total mass of the outermost layer forming composition.

A method for preparing the outermost layer forming coating solution is not particularly limited, and a known method can be used. When the outermost layer forming composition contains a dispersion medium, the outermost layer forming coating solution is preferably prepared by a method for adding the silicone surface-treated particles and the polymerizable monomer to be contained in the outermost layer forming composition and optionally used polymerization initiator, charge transport agent, and other components to the dispersion medium. A method for forming the outermost layer is not particularly limited, and a known method can be used. The outermost layer is preferably formed by a method for forming a coated film of the prepared outermost layer forming coating solution, and drying and curing the coated film (polymerizing the coated film by irradiation with an actinic ray such as an ultraviolet ray or an electron beam).

In the outermost layer, the polymerizable monomer constitutes a polymer (polymerized cured product). Here, when the silicone surface-treated particles have a polymerizable group, in the outermost layer, the polymerizable monomer and the silicone surface-treated particles having a polymerizable group constitute an integral polymer forming the outermost layer (polymerized cured product). It can be confirmed by analysis of the above polymer (polymerized cured product) using a known instrumental analysis technique such as pyrolysis GC-MS, nuclear magnetic resonance (NMR), Fourier transform infrared spectrophotometer (FT-IR), or elemental analysis that the polymerized cured product is a polymer of a polymerizable monomer (polymerized cured product) or a polymer of a polymerizable monomer and silicone surface-treated particles having a polymerizable group (polymerized cured product).

<Electrophotographic Image Forming Apparatus and Electrophotographic Image Forming Method>

An electrophotographic photoreceptor according to an embodiment of the present invention is used as an electrophotographic photoreceptor (organic photoreceptor) in an electrophotographic type image forming apparatus (electrophotographic image forming apparatus, hereinafter, also simply referred to as an image forming apparatus). Therefore, another embodiment of the present invention relates to an electrophotographic image forming apparatus including the above-described electrophotographic photoreceptor.

The image forming apparatus is not particularly limited, and a known image forming apparatus can be used. Preferred examples thereof include an image forming apparatus including: a photoreceptor; a charging device for charging a surface of the photoreceptor; an exposing device for irradiating the charged surface of the photoreceptor with light to form an electrostatic latent image; a developing device for supplying toner to the photoreceptor on which the electrostatic latent image has been formed to form a toner image; and a transfer device for transferring the toner image on the surface of the photoreceptor onto a recording medium. The image forming apparatus preferably further includes a cleaning device for removing toner remaining on the surface of the photoreceptor after the toner image is transferred onto the recording medium in addition to these devices.

That is, the photoreceptor is preferably applied to an electrophotographic photoreceptor (organic photoreceptor) in an electrophotographic type image forming method (electrophotographic image forming method, hereinafter, also simply referred to as an image forming method). This method is an image forming method including: charging a surface of a photoreceptor (charging step); irradiating the charged surface of the photoreceptor with light to form an electrostatic latent image (exposure step); supplying toner to the surface of the photoreceptor on which the electrostatic latent image has been formed to form a toner image corresponding to the electrostatic latent image (developing step); and transferring the toner image from the surface of the photoreceptor onto a recording medium (transfer step). Therefore, another embodiment of the present invention relates to an electrophotographic image forming method using the above-described electrophotographic photoreceptor, including at least a charging step, an exposure step, a developing step, and a transfer step. This method preferably further includes performing cleaning to remove toner remaining on the surface of the photoreceptor after the toner image is transferred onto the recording medium (cleaning step). The image forming method is performed, for example, by the above image forming apparatus.

Hereinafter, an image forming apparatus according to an embodiment of the present invention will be described with reference to the attached drawings. However, the present invention is not limited only to the embodiment described below.

FIG. 1 is a schematic cross-sectional view exemplifying a configuration of an image forming apparatus according to an embodiment the present invention. An image forming apparatus 100 illustrated in FIG. 1 includes an image reader 110, an image processor 30, an image former 40, a sheet conveyor 50, and a fixing device 60.

The image former 40 includes image forming units 41Y, 41M, 41C, and 41K that form images using toners of yellow (Y), magenta (M), cyan (C), and black (K), respectively. These units have the same configuration except for toner to be contained therein, and therefore symbols representing colors may be omitted below for these units and devices constituting these units. The image former 40 further includes an intermediate transfer unit 42 and a secondary transfer unit 43. These units correspond to a transfer device.

The image forming unit 41 includes an exposing device 411, a developing device 412, a photoreceptor 413 as described above, a charging device 414, and a drum cleaning device 415. The charging device 414 is, for example, a corona charger. The charging device 414 may be a contact charging device that charges a contact charging member such as a charging roller, a charging brush, or a charging blade in contact with the photoreceptor 413. The exposing device 411 includes, for example, a semiconductor laser as a light source and a light deflecting device (polygon motor) that emits laser light according to an image to be formed toward the photoreceptor 413.

The developing device 412 is a two-component developing type developing device. The developing device 412 includes, for example, a developing container that contains a two-component developer, a developing roller (magnetic roller) rotatably disposed in an opening of the developing container, a partition wall partitioning the interior of the developing container so as to make communication of the two-component developer possible, a conveying roller for conveying the two-component developer on the opening side of the developing container toward the developing roller, and a stirring roller for stirring the two-component developer in the developing container. The developing container contains, for example, a two-component developer.

When a lubricant is applied to the photoreceptor 413, the lubricant is disposed, for example, in the drum cleaning device 415 or between the drum cleaning device 415 and the charging device 414 so as to be in contact with a surface of the photoreceptor after transfer. Alternatively, the lubricant may be supplied to a surface of the photoreceptor 413 at the time of development as an external additive of the two-component developer.

The intermediate transfer unit 42 includes an intermediate transfer belt 421, a primary transfer roller 422 that presses the intermediate transfer belt 421 against the photoreceptor 413, a plurality of support rollers 423 including a backup roller 423A, and a belt cleaning device 426. The intermediate transfer belt 421 is stretched in a loop shape by the plurality of support rollers 423. By rotation of at least one driving roller of the plurality of support rollers 423, the intermediate transfer belt 421 travels at a constant speed in a direction of the arrow A.

The secondary transfer unit 43 includes an endless secondary transfer belt 432 and a plurality of support rollers 431 including a secondary transfer roller 431A. The secondary transfer belt 432 is stretched in a loop shape by the secondary transfer roller 431A and the support rollers 431.

The fixing device 60 includes, for example, a fixing roller 62, an endless heat generating belt 10 for coating an outer peripheral surface of the fixing roller 62 and heating and melting toner constituting a toner image on a sheet S, and a pressure roller 63 that presses the sheet S against the fixing roller 62 and the heat generating belt 10. The sheet S corresponds to a recording medium.

The image forming apparatus 100 further includes the image reader 110, the image processor 30, and the sheet conveyor 50. The image reader 110 includes a sheet feeding device 111 and a scanner 112. The sheet conveyor 50 includes a sheet feeder 51, a sheet discharger 52, and a conveying path 53. Three sheet feeding tray units 51*a* to 51*c* constituting the sheet feeder 51 contain the sheets S (standard sheet and special sheet) identified based on basis weight, size, and the like according to the type set in advance. The conveying path 53 includes a plurality of conveying roller pairs such as a resist roller pair 53*a*.

Formation of an image by the image forming apparatus 100 will be described. The scanner 112 optically scans and reads a document D on a contact glass. Reflected light from the document D is read by a CCD sensor 112*a* and becomes input image data. The input image data is subjected to predetermined image processing in the image processor 30 and sent to the exposing device 411.

The photoreceptor 413 rotates at a constant peripheral speed. The charging device 414 negatively charges a surface of the photoreceptor 413 uniformly. In the exposing device 411, a polygon mirror of the polygon motor rotates at a high speed, laser light corresponding to input image data of each color component develops in an axial direction of the photoreceptor 413, and an outer peripheral surface of the photoreceptor 413 is irradiated with the laser light in the axial direction. In this way, an electrostatic latent image is formed on a surface of the photoreceptor 413.

In the developing device 412, the two-component developer in the developing container is stirred and conveyed to charge toner particles, conveyed to a developing roller, and forms a magnetic brush on a surface of the developing roller. The charged toner particles electrostatically adhere to an electrostatic latent image portion on the photoreceptor 413 from the magnetic brush. In this way, the electrostatic latent image on the surface of the photoreceptor 413 is visualized, and a toner image corresponding to the electrostatic latent image is formed on the surface of the photoreceptor 413. Note that the "toner image" refers to a state in which toner is aggregated in an image shape.

The toner image on the surface of the photoreceptor 413 is transferred onto the intermediate transfer belt 421 by the intermediate transfer unit 42. A transfer residual toner remaining on the surface of the photoreceptor 413 after the transfer is removed by the drum cleaning device 415 having a drum cleaning blade in sliding contact with the surface of the photoreceptor 413.

As described above, the outermost layer of the photoreceptor 413 is formed of a polymerized cured product of a composition containing a polymerizable monomer and silicone surface-treated particles. The silicone surface-treated particles are uniformly dispersed not only in a surface layer portion of the outermost layer but also throughout the outermost layer in a film thickness direction thereof. Therefore, after the surface layer portion is lost due to wear, the silicone surface-treated particles present inside appear in the surface layer portion and exhibit their functions. This makes it possible to obtain an effect of achieving high image quality for a long time by suppressing occurrence of fogging while improving abrasion resistance.

The primary transfer roller 422 presses the intermediate transfer belt 421 against the photoreceptor 413. As a result, a primary transfer nip is formed for each photoreceptor by the photoreceptor 413 and the intermediate transfer belt 421. At the primary transfer nip, a toner image of each color is sequentially superposed and transferred onto the intermediate transfer belt 421.

Meanwhile, the secondary transfer roller 431A is pressed against the backup roller 423A via the intermediate transfer belt 421 and the secondary transfer belt 432. As a result, a secondary transfer nip is formed by the intermediate transfer belt 421 and the secondary transfer belt 432. The sheet S passes through the secondary transfer nip. The sheet S is conveyed to the secondary transfer nip by the sheet conveyor 50. Correction of an inclination of the sheet S and adjustment of the timing of conveyance are performed by a resist roller unit having the resist roller pair 53*a* disposed therein.

When the sheet S is conveyed to the secondary transfer nip, a transfer bias is applied to the secondary transfer roller 431A. By application of this transfer bias, a toner image carried on the intermediate transfer belt 421 is transferred onto the sheet S. The sheet S onto which the toner image has been transferred is conveyed toward the fixing device 60 by the secondary transfer belt 432.

In the fixing device 60, the heat generating belt 10 and the pressure roller 63 form a fixing nip, and the fixing nip heats and presses the sheet S that has been conveyed. In this way, the toner image is fixed to the sheet S. The sheet S to which the toner image has been fixed is discharged to the outside of the device by the sheet discharger 52 having a discharge roller 52*a*.

Note that transfer residual toner remaining on a surface of the intermediate transfer belt 421 after the secondary transfer is removed by the belt cleaning device 426 having a belt cleaning blade in sliding contact with a surface of the intermediate transfer belt 421.

EXAMPLES

An effect of the present invention will be described using the following Examples and Comparative Examples. However, the technical scope of the present invention is not limited only to the following Examples. Note that, in the following Examples, operations were performed at room temperature (25° C.) unless otherwise specified. Note that "%" and "parts" mean "% by mass" and "parts by mass", respectively, unless otherwise specified.

Preparation of Surface-Treated Metal Oxide Particles

Preparation Example 1 of Surface-Treated Metal Oxide Particles

To 100 mL of ethanol, 10 g of tin oxide as untreated metal oxide particles (number average primary particle diameter=20 nm, specific surface area (BET specific surface area) measured by nitrogen adsorption method=70 $m^2/g$) was added, and dispersion was performed for 60 minute using a US homogenizer. Subsequently, 0.3 g of a reactive surface treatment agent S-16 (KBM-503 manufactured by Shin-Etsu Chemical Co., Ltd.) and 10 mL of toluene were added thereto, and dispersion was performed for 30 minutes using a US homogenizer. The solvent was removed with an evaporator. Thereafter, the residue was heated at 120° C. for one hour to obtain metal oxide particles surface-treated with the reactive surface treatment agent.

The obtained metal oxide particles which had been subjected to reactive surface treatment were added to 80 g of 2-butanol, and dispersion was performed for 60 minutes using a US homogenizer. Subsequently, 0.7 g of a surface treatment agent A having a silicone chain as a side chain of a silicone main chain (KF-9908 manufactured by Shin-Etsu Chemical Co., Ltd.) and 10 mL of toluene were added thereto, and dispersion was further performed for 30 minutes using a US homogenizer. After the dispersion, the solvent was volatilized at room temperature, and the residue was dried at 120° C. for 60 minutes to prepare silicone surface-treated particles P-1.

Preparation Examples 2, 3, 5, 6, 8 to 16, 20, and 21 of Surface-Treated Metal Oxide Particles Surface-treated metal oxide particles P-2, 3, 5, 6, 8 to 16, 20, and 21 were prepared in a similar manner to Preparation Example 1 of coated particles except that the type of the untreated metal oxide particles and the types and amounts of the reactive surface treatment agent and the silicone surface treatment agent were changed according to Table 1.

Preparation Example 4 of Surface-Treated Metal Oxide Particles 10 g of silicon oxide as untreated metal oxide particles (number average primary particle diameter=60 nm, BET specific surface area=80 $m^2/g$) was added to 80 g of 2-butanol, and dispersion was performed for 60 minutes using a US homogenizer. Subsequently, 1 g of a surface treatment agent (KF-9908 manufactured by Shin-Etsu Chemical Co., Ltd.) having a silicone chain as a side chain of a silicone main chain and 10 mL of toluene were added thereto, and dispersion was further performed for 30 minutes using a US homogenizer. After the dispersion, the solvent was volatilized at room temperature, and the residue was dried at 120° C. for 60 minutes to prepare metal oxide particles P-4 surface-treated with the surface treatment agent having a silicone chain.

Preparation Examples 7 and 17 to 19 of Surface-Treated Metal Oxide Particles Surface-treated metal oxide particles P-7 and 17 to 19 were prepared in a similar manner to Preparation Example 4 of surface-treated metal oxide particles except that the type of the untreated metal oxide particles and the type and amount of the silicone surface treatment agent were changed according to Table 1.

Note that in Table 1 below, a number average primary particle diameter is represented by r (nm), and a sphere equivalent particle diameter calculated from a specific surface area measured by a nitrogen adsorption method is represented by r' (nm).

(Surface Treatment Amount with Surface Treatment Agent Having Silicone Chain Per Surface Area of Metal Oxide Particles)

The surface treatment amount with the surface treatment agent having a silicone chain per surface area of the metal oxide particles (untreated metal oxide particles) was calculated by the following formula;

Surface treatment amount by surface treatment agent having silicone chain per surface area of metal oxide particles [g/m$^2$]=addition amount of surface treatment agent [g]/{addition amount of metal oxide particles [g]}×specific surface area (SA) of metal oxide particles [m$^2$/g]} [Numerical formula 5]

(Surface Treatment Agent Used)

Details of the surface treatment agent having a silicone chain and the reactive surface treatment agent described in Table 1 below are described below;

Surface treatment agent A: KF-9908 manufactured by Shin-Etsu Chemical Co., Ltd., branched silicone surface treatment agent having a silicone chain as a side chain of a silicone main chain, Surface treatment agent B: KF-9909 manufactured by Shin-Etsu Chemical Co., Ltd., branched silicone surface treatment agent having a silicone chain as a side chain of a silicone main chain, Surface treatment agent C: KF-574 manufactured by Shin-Etsu Chemical Co., Ltd., branched silicone surface treatment agent having a silicone chain as a side chain of a poly (meth)acrylate main chain, Surface treatment agent D: KF-578 manufactured by Shin-Etsu Chemical Co., Ltd., branched silicone surface treatment agent having a silicone chain as a side chain of an acrylic main chain, Surface treatment agent E: KF-99 manufactured by Shin-Etsu Chemical Co., Ltd., linear silicone surface treatment agent (methyl hydrogen silicone oil), and Surface treatment agent F: KF-9901 manufactured by Shin-Etsu Chemical Co., Ltd., linear silicone surface treatment agent (methyl hydrogen silicone oil).

Surface treatment agent S-16: KBM-503 manufactured by Shin-Etsu Chemical Co., Ltd., silane coupling agent having a radically polymerizable group (3-methacryloxypropyl trimethoxysilane), and Surface treatment agent S-20: KBM-5803 manufactured by Shin-Etsu Chemical Co., Ltd., silane coupling agent having a radically polymerizable group (8-methacryloxyoctyl trimethoxysilane).

(Composite Particle Having Core-Shell Structure to be Used)

Details of a composite particle having a core-shell structure described in Table 1 below are described below;

$BaSO_4/SnO_2$: a composite particle having a core-shell structure, including a core material (core) formed of barium sulfate ($BaSO_4$) and an outer shell (shell) formed of tin oxide ($SnO_2$), and $SiO_2/SnO_2$—Sb: a composite particle having a core-shell structure, including a core material (core) formed of silica ($SiO_2$) and an outer shell (shell) formed of antimony-doped tin oxide ($SnO_2$—Sb).

Preparation of Electrophotographic Photoreceptor

Preparation Example 1 of Photoreceptor (1) Preparation of Conductive Support

A surface of a cylindrical aluminum support was cut to prepare a conductive support.

(2) Formation of Intermediate Layer 10 parts by mass of polyamide resin (X1010 manufactured by Daicel-Evonik Ltd.), 11 parts by mass of titanium oxide (SMT-500SAS manufactured by Tayca Co., Ltd., number average primary particle diameter: 0.035 μm), and 200 parts by mass of ethanol were mixed, and dispersion was performed for 10 hours by a batch method using a sand mill as a dispersing machine to form an intermediate layer forming coating solution. Subsequently, the obtained intermediate layer forming coating solution was applied onto the conductive support by a dip coating method and dried at 110° C. for 20 minutes to form an intermediate layer having a dry film thickness of 2 μm.

(3) Formation of Charge Generating Layer 24 parts by mass of charge generating material (mixed crystal of 1:1 adduct of titanyl phthalocyanine and (2R,3R)-2,3-butanediol having clear peaks at 8.3°, 24.7°, 25.1°, and 26.5° in Cu-Kα characteristic X-ray diffraction spectrum measurement and unadded titanyl phthalocyanine), 12 parts by mass of polyvinyl butyral resin (S-LEC (registered trademark) BL-1 manufactured by Sekisui Chemical Co., Ltd.), and 400 parts by mass of 3-methyl-2-butanone/cyclohexanone=4/1 (volume ratio) were mixed, and dispersion was performed at 19.5 kHz at 600 W at a circulation flow rate of 40 L/H for 0.5 hours using a circulation type ultrasonic homogenizer (RUS-600TCVP manufactured by NIHONSEIKI KAISHA LTD.) to prepare a charge generating layer forming coating solution. Subsequently, the obtained charge generating layer forming coating solution was applied onto the intermediate layer by a dip coating method and dried to form a charge generating layer having a dry film thickness of 0.3 μm.

(4) Formation of Charge Transporting Layer 60 parts by mass of charge transporting material represented by the following structural formula (4)

100 parts by mass of polycarbonate resin (Z300 manufactured by Mitsubishi Gas Chemical Co., Ltd.)

4 parts by mass of antioxidant (IRGANOX (registered trademark) 1010 manufactured by BASF SE)

800 parts by mass of toluene/tetrahydrofuran 1 part by mass of silicone oil

The above materials for the charge transporting layer were mixed and dissolved to prepare a charge transporting layer coating solution. The coating solution was applied to a surface of the charge generating layer by a dip coating method, and dried at 120° C. for 70 minutes to form a charge transporting layer having a film thickness of 24 μm on the charge generating layer. Note that the toluene/tetrahydrofuran is a mixed solvent obtained by mixing 1 part by volume of toluene with respect to 9 parts by volume of THF. The silicone oil is "KF-54" (manufactured by Shin-Etsu Chemical Co., Ltd.).

[Chemical formula 5]

Formula (4)

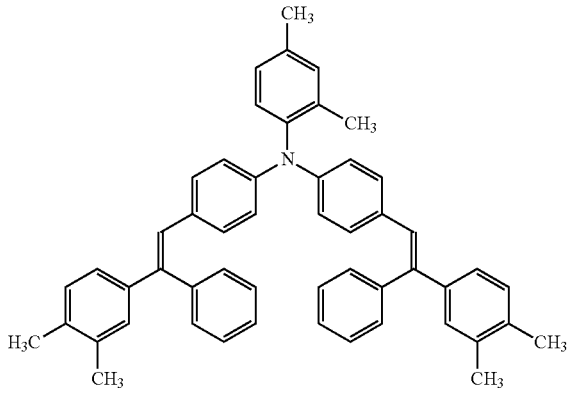

(5) Formation of Protective Layer (Outermost Layer)

60 parts by mass of radically polymerizable monomer (trimethylolpropane trimethacrylate), 20 parts by mass of charge transporting material represented by the following structural formula (5), 100 parts by mass of surface-treated metal oxide particles (surface-treated metal oxide particles P-1 obtained in the preparation of the surface-treated metal oxide particles), 5 parts by mass of polymerization initiator (IRGACURE (registered trademark) 819 manufactured by BASF Japan Ltd.), 300 parts by mass of 2-butanol, and 30 parts by mass of tetrahydrofuran were mixed, and the solutes and dispersoids were dissolved and dispersed to prepare a protective layer forming coating solution (outermost layer forming coating solution). Subsequently, the obtained protective layer forming coating solution was applied onto the charge transporting layer using a circular slide hopper coater, and then irradiated with an ultraviolet ray at 16 mW/cm$^2$ for one minute (integrated light amount 960 mJ/cm$^2$) using a metal halide lamp to form a protective layer having a dry film thickness of 3.0 μm, thus preparing a photoreceptor 1.

[Chemical formula 6]

Formula (5)

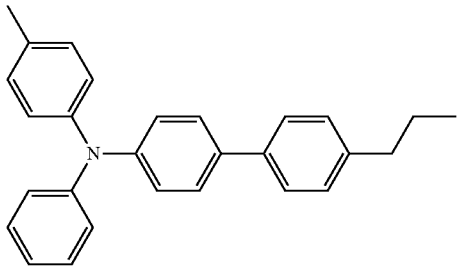

Preparation Examples 2 to 21 of Photoreceptor

Photoreceptors 2 to 21 were prepared in a similar manner to Preparation Example 1 of photoreceptor except that the surface-treated metal oxide particles used for preparing the protective layer were changed as illustrated in Table 1.

Note that the protective layer corresponds to the outermost layer in each of the photoreceptors prepared by the above method.

In the protective layers of photoreceptors 1 to 21, it was confirmed that silicon, which is a chemical species derived from a surface treatment agent, was present on surfaces of the metal oxide particles of silicone surface-treated particles P-1 to 21.

In the protective layers of photoreceptors 1 to 3, 5, 6, 8 to 16, 20, and 21, silicone surface-treated particles P-1 to 3, 5, 6, 8 to 16, 20, and 21 had groups derived from a polymerizable group, respectively.

<Evaluation>

The following evaluation was performed on each of the obtained photoreceptors.

(Wear (Abrasion Resistance))

Each of the photoreceptors obtained above was mounted on a full-color printer (bizhubPRESS (registered trademark) C1070 manufactured by Konica Minolta Inc.) and subjected to an endurance test for continuously printing 200,000 sheets of cyan solid longitudinal image with 50% coverage in an A4 transverse feed direction under an environment of 20° C. and 50% RH. The film thickness wear amount of a protective layer as an outermost layer of each of the photoreceptors after the endurance test was evaluated. Specifically, 10 uniform film thickness portions (portions obtained by preparing a film thickness profile of the protective layer and excluding a film thickness fluctuation portion at a leading end and a rear end of the coating) were randomly selected and measured, and an average value thereof was taken as the film thickness of a protective layer. As a film thickness measuring device, an eddy current type film thickness measuring device (EDDY560C manufactured by HELMUT FISCHER GMBTE CO) was used. Then, the film thickness wear amount (μm) of a protective layer was calculated from a difference in the thickness of the protective layer before and after the endurance test. Note that toner attached to the full-color printer contains a copolymer of a styrene-based monomer and a (meth)acrylate-based monomer as a binder resin. In this evaluation, if the film thickness wear amount of a protective layer is 2.0 μm or less, there is no problem in practical use. Therefore, the film thickness wear amount of 2.0 μm or less was regarded to be a good result. The following Table 1 illustrates results thereof;

[Evaluation Criteria]

A: The film thickness wear amount of a protective layer is 1.0 μm or less,

B: The film thickness wear amount of a protective layer is more than 1.0 μm and 2.0 μm or less, and C: The film thickness wear amount of a protective layer is more than 2.0 μm.

(Fogging)

Each of the photoreceptors obtained above was mounted on a full-color printer (bizhub (registered trademark) PRESS C1070 manufactured by Konica Minolta Inc.) and subjected to an endurance test for continuously printing 200,000 sheets of cyan solid longitudinal image with 50% coverage in an A4 transverse feed direction under an environment of 20° C. and 50% RH. Subsequently, 20 sheets of white solid image were printed under an environment of 20° C. and 50% RH using the above full-color printer having each of the photoreceptors after the endurance test mounter thereon, and the 20th image was scanned by a scanner. The scanned image was captured by an image editing software (Adobe Photoshop (registered trademark) CS6 manufactured by Adobe Systems Inc.) and converted into a monochrome image. Thereafter, a black ratio of the scanned image was calculated using the same software. As for this black ratio, a value obtained by averaging 10 points was adopted as a blackening ratio. Here, a portion covered with toner on a white background portion is recognized as black. That is, the blackening ratio represents an area ratio of a black dot portion of an image, and is 100% for a solid black image and 0% for a white sheet. Note that toner attached to the full-color printer contains a copolymer of a styrene-based monomer and a (meth)acrylate-based monomer as a binder resin. In this evaluation, if the blackening ratio is less than 0.15%, there is no problem in practical use, and the blackening ratio of less than 0.30 falls within a practically acceptable range. Therefore, the blackening ratio of less than 0.30 was regarded to be a good result. The following Table 1 illustrates results thereof;

[Evaluation Criteria]

A: The blackening ratio is less than 0.05%,

B: The blackening ratio is 0.05% or more and less than 0.15%,

C: The blackening ratio is 0.15% or more and less than 0.3%, and

D: The blackening ratio is 0.3% or more.

present invention, had a poor result in at least one of the film thickness wear amount and the degree of fogging.

Particularly, as in Examples 8 to 11, 13, and 16 of the present invention, when the surface-treated metal oxide particles (coated particles) were formed from core-shell structure composite particles having a number average primary particle diameter of 80 to 200 nm as untreated metal oxide particles, the surface treatment agent having a silicone chain was a branched silicone surface treatment agent having a poly (meth)acrylate main chain or a silicone main chain and having a silicone chain as a side chain, and the surface-treated metal oxide particles had a group derived from a polymerizable functional group, it was confirmed that a particularly good result was obtained.

Although embodiments of the present invention have been described and illustrated in detail, the disclosed embodiments are made for purposes of illustration and example only and not limitation. The scope of the present invention should be interpreted by terms of the appended claims

What is claimed is:

1. An electrophotographic photoreceptor comprising an outermost layer formed of a polymerized cured product of a

TABLE 1

| | | Silicone surface-treated particles contained in protective layer (outermost layer) | | | | | | | | | | | | |
|---|---|---|---|---|---|---|---|---|---|---|---|---|---|---|
| | | | Untreated metal oxide particles (Untreated base particles) | | | | | Surface treatment | | | | | | |
| | | | | | | | | Surface treatment agent having silicone chain | | | Reactive surface treatment agent | | | |
| | Photo-receptor | Type | Type | r (nm) | Specific surface area ($m^2/g$) | r' (mn) | r/r' | Type | Addition amount (g) | Surface treatment amount per surface area of untreated metal oxide particles ($g/m^2$) | Type | Addition amount (g) | Evaluation Wear | Evaluation Fogging |
| Example 1 | 1 | P-1 | $SnO_2$ | 20 | 70 | 12 | 1.6 | A | 0.7 | 0.0010 | S-16 | 0.3 | A | C |
| Example 2 | 2 | P-2 | $SnO_2$ | 50 | 30 | 29 | 1.7 | A | 0.3 | 0.0010 | S-16 | 0.2 | A | B |
| Example 3 | 3 | P-3 | $TiO_2$ | 50 | 50 | 29 | 1.8 | A | 0.4 | 0.0008 | S-16 | 0.3 | A | B |
| Example 4 | 4 | P-4 | $SiO_2$ | 60 | 80 | 34 | 1.8 | A | 1.0 | 0.0013 | Not treated | | B | B |
| Example 5 | 5 | P-5 | $SiO_2$ | 60 | 80 | 34 | 1.8 | A | 0.8 | 0.0010 | S-16 | 0.3 | A | B |
| Example 6 | 6 | P-6 | $SiO_2$ | 60 | 80 | 34 | 1.8 | E | 0.8 | 0.0010 | S-16 | 0.3 | A | C |
| Example 7 | 7 | P-7 | $BaSO_4/SnO_2$ | 100 | 40 | 29 | 3.5 | A | 0.6 | 0.0015 | Not treated | | B | A |
| Example 8 | 8 | P-8 | $BaSO_4/SnO_2$ | 100 | 40 | 29 | 3.5 | A | 0.4 | 0.0010 | S-16 | 0.2 | A | A |
| Example 9 | 9 | P-9 | $BaSO_4/SnO_2$ | 100 | 40 | 29 | 3.5 | B | 0.4 | 0.0010 | S-16 | 0.2 | A | A |
| Example 10 | 10 | P-10 | $BaSO_4/SnO_2$ | 100 | 40 | 29 | 3.5 | C | 0.4 | 0.0010 | S-16 | 0.2 | A | A |
| Example 11 | 11 | P-11 | $BaSO_4/SnO_2$ | 100 | 40 | 29 | 3.5 | D | 0.4 | 0.0010 | S-16 | 0.2 | A | A |
| Example 12 | 12 | P-12 | $BaSO_4/SnO_2$ | 100 | 40 | 29 | 3.5 | F | 0.4 | 0.0010 | S-16 | 0.2 | A | C |
| Example 13 | 13 | P-13 | $BaSO_4/SnO_2$ | 200 | 30 | 38 | 5.2 | A | 0.3 | 0.0010 | S-20 | 0.2 | A | A |
| Example 14 | 14 | P-14 | $BaSO_4/SnO_2$ | 250 | 25 | 46 | 5.4 | A | 0.3 | 0.0012 | S-20 | 0.2 | B | C |
| Example 15 | 15 | P-15 | $SiO_2/SnO_2$—Sb | 50 | 70 | 19 | 2.6 | A | 0.8 | 0.0011 | S-16 | 0.3 | A | B |
| Example 16 | 16 | P-16 | $SiO_2/SnO_2$—Sb | 80 | 50 | 27 | 3.0 | B | 0.3 | 0.0006 | S-16 | 0.2 | A | A |
| Comparative Example 1 | 17 | P-17 | $SnO_2$ | 100 | 10 | 87 | 1.2 | A | 0.4 | 0.0040 | Not treated | | C | D |
| Comparative Example 2 | 18 | P-18 | $SnO_2$ | 100 | 10 | 87 | 1.2 | A | 0.1 | 0.0010 | Not treated | | B | D |
| Comparative Example 3 | 19 | P-19 | $SnO_2$ | 250 | 30 | 29 | 8.6 | A | 0.3 | 0.0010 | Not treated | | B | D |
| Comparative Example 4 | 20 | P-20 | $BaSO_4/SnO_2$ | 100 | 40 | 29 | 3.5 | A | 0.8 | 0.0020 | S-16 | 0.2 | C | B |
| Comparative Example 5 | 21 | P-21 | $BaSO_4/SnO_2$ | 100 | 40 | 29 | 3.5 | A | 0.1 | 0.0003 | S-16 | 0.2 | A | D |

From the results of Table 1 above, it was confirmed that the electrophotographic photoreceptor according to any one of Examples of the present invention had small film thickness wear amount, had a small degree of fogging, and exhibited a good result. Meanwhile, it was confirmed that the electrophotographic photoreceptor according to any one of Comparative Examples, which is outside the scope of the composition containing a polymerizable monomer and metal oxide particles surface-treated with a surface treatment agent having a silicone chain, wherein a ratio (r/r') between a number average primary particle diameter (r) of metal oxide particles which are untreated base particles of the metal oxide particles surface-treated with the surface treatment agent having a silicone chain and a sphere equivalent particle diameter (r') of the untreated base particles calculated from a specific surface area measured by a nitrogen adsorption method is 1.5 or more and 6.0 or less, and a surface treatment amount with the surface treatment agent having a silicone chain per surface area of the untreated base particles is 0.0005 $g/m^2$ or more and 0.0015 $g/m^2$ or less.

2. The electrophotographic photoreceptor according to claim 1, wherein the number average primary particle diameter (r) of the untreated base particles is 50 nm or more and 200 nm or less.

3. The electrophotographic photoreceptor according to claim 1, wherein each of the untreated base particles is a composite particle having a core-shell structure, including a core material and an outer shell formed of metal oxide.

4. The electrophotographic photoreceptor according to claim 1, wherein the surface treatment agent having a silicone chain is a branched silicone surface treatment agent having a silicone chain as a side chain.

5. The electrophotographic photoreceptor according to claim 1, wherein the branched silicone surface treatment agent has a poly (meth)acrylate main chain or a silicone main chain as a main chain.

6. The electrophotographic photoreceptor according to claim 1, wherein the metal oxide particles surface-treated with the surface treatment agent having a silicone chain have a group derived from a polymerizable group.

7. An electrophotographic image forming method using the electrophotographic photoreceptor according to claim 1, comprising at least charging, exposing, developing, and transferring.

8. An electrophotographic image forming apparatus comprising the electrophotographic photoreceptor according to claim 1.

* * * * *